United States Patent [19]

Baron

[11] Patent Number: 5,022,153

[45] Date of Patent: Jun. 11, 1991

[54] SHAVING APPARATUS

[75] Inventor: Sint Baron, Drachten, Netherlands

[73] Assignee: U.S. Philips Corporation, New York, N.Y.

[21] Appl. No.: 626,325

[22] Filed: Dec. 13, 1990

Related U.S. Application Data

[63] Continuation of Ser. No. 536,905, Jun. 12, 1990, abandoned.

[30] Foreign Application Priority Data

Jul. 7, 1989 [NL] Netherlands ..... 8901739

[51] Int. Cl.[5] ..... B26B 19/06

[52] U.S. Cl. ..... 30/34.1; 30/346.51

[58] Field of Search ..... 30/34.1, 43.9, 34.05, 30/346.51

[56] References Cited

U.S. PATENT DOCUMENTS 4,380,869 4/1983 Shirakawa et al. ..... 30/34.1

4,509,259 4/1985 Kakumoto et al. ..... 30/34.1

*Primary Examiner*—Douglas D. Watts

*Attorney, Agent, or Firm*—Ernestine C. Bartlett

[57] ABSTRACT

A shaving apparatus comprising a housing having a shaving part for short hairs and a trimmer for long hairs which is rotatable with respect to the housing, the housing comprising an operating member which is coupled to the trimmer via a connection element, one end of the connection element being journalled in the trimmer so as to be rotatable. An "over-center" mechanism is present between trimmer and connection element, with a resilient element at one component, which resilient element engages a cam of the other component.

5 Claims, 2 Drawing Sheets

SHAVING APPARATUS

This is a continuation of application Ser. No. 536,905, filed June 12, 1990 now abandoned.

FIELD OF THE INVENTION

The invention relates to a shaving apparatus comprising a housing having a shaving part for short hairs and a trimmer for long hairs which can be rotated with respect to the housing, the housing comprising an operating member which is coupled to the trimmer via a connection element, one end of the connection element being journalled in the trimmer so as to be rotatable.

BACKGROUND OF THE INVENTION

Such a shaving apparatus is known, for example, from U.S. Pat. No. 4 380 869. The construction described therein for shifting the trimmer in the various positions and for locking the trimmer in said positions comprises many components and requires considerable space.

SUMMARY OF THE INVENTION

It is the object of the invention to provide a construction which is simpler and can hence be manufactured more cheaply and which is characterized in that an "over-centre" mechanism is present between the trimmer and the connection element and comprises a resilient element at one component, which resilient element engages a cam of the other component.

This object is accomplished in a shaving apparatus which comprises a housing having a shaving part for short hairs and a trimmer for long hairs which can be rotated with respect to the housing, the housing comprising an operating member which is coupled to the trimmer via a connection element, one end of the connection element being journalled in the trimmer so as to be rotatable, an "over-center" mechanism being present between the trimmer and the connection element and comprising a resilient element at one component, which resilient element engages a cam of the other component.

Particularly, the object is accomplished in a shaving apparatus which comprises a housing having a shaving part for short hairs and a trimmer for long hairs which can be rotated between two positions which respect to the housing, the housing comprising an operating member which is coupled to the trimmer via a connection element, one end of the connection element being journalled in the trimmer so as to be rotatable, the combination of trimmer and connection element comprising a resilient element connected to one of these components and a cam connected to the other component, the trimmer being fixed in either of the two positions by a force between the resilient element and the cam, whereby from moving the trimmer from one position to the other position an increase and subsequently a decrease of the force between the resilient element and the cam occurs, the resilient element and the cam thus forming an "over-center" mechanism.

Special embodiments are stated in the sub-claims wherein: the connection element comprises a spindle which is situated in a recess of the trimmer so as to be rotatable and the resilient element is connected to the trimmer and also forms a locking member for the spindle in the recess; and/or the connection element comprises two ends which are both journalled in the trimmer so as to be rotatable and each end comprises a cam which forms an "over-center" mechanism with a resilient element connected to the trimmer and both resilient elements are parts of a resilient element of sheet material; and/or the resilient member comprises bent connection lugs having hook-like portions, which connection lugs are situated in corresponding recesses of the trimmer.

BRIEF DESCRIPTION OF THE DRAWINGS

The invention will now be described in greater detail with reference to a description of an embodiment shown in the Figures.

DESCRIPTION OF PREFERRED EMBODIMENTS

Figure 1:
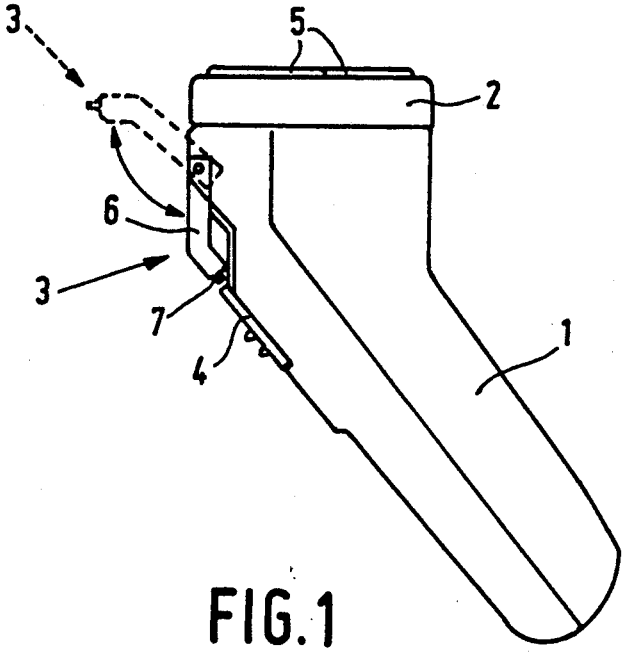
FIG. 1 is a side elevation of a shaving apparatus.

The shaving apparatus shown in FIG. 1 comprises a housing 1 having a shaving part 2 for short hairs and a trimmer 3 for long hairs. The trimmer is connected to the housing so as to be rotatable and can be rotated by means of an operating member 4 between a non-operational position as shown in the Figure with solid lines and an operational position as is shown with broken lines.

The shaving part 2 for short hairs comprises, for example, cutting units 5 of the known so-called rotating type. The trimmer 3 comprises a holder 6 and a cutting unit 7.

Figure 2:
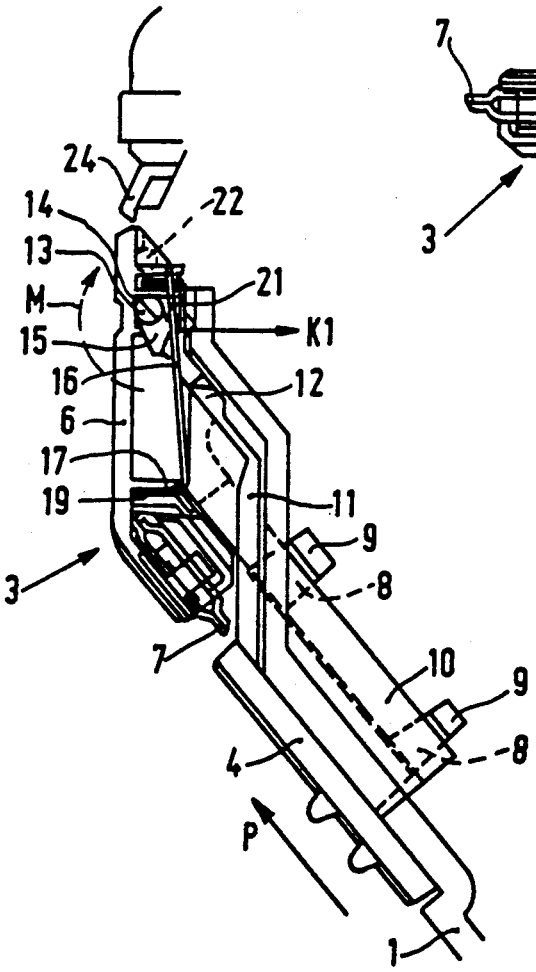
FIG. 2 is a cross-sectional view of a detail of the shaving apparatus of FIG. 1 with the trimmer in the non-operational position.
Figure 4:
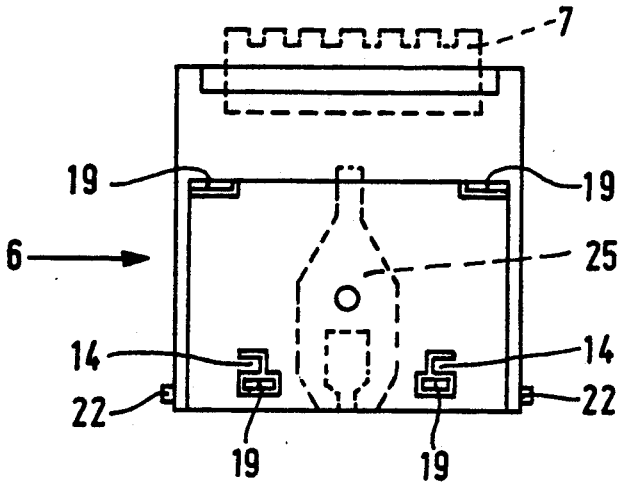
FIGS. 4, 5 and 6 are elevations of a few components of the FIGS. 3 and 4 construction.
Figure 5:
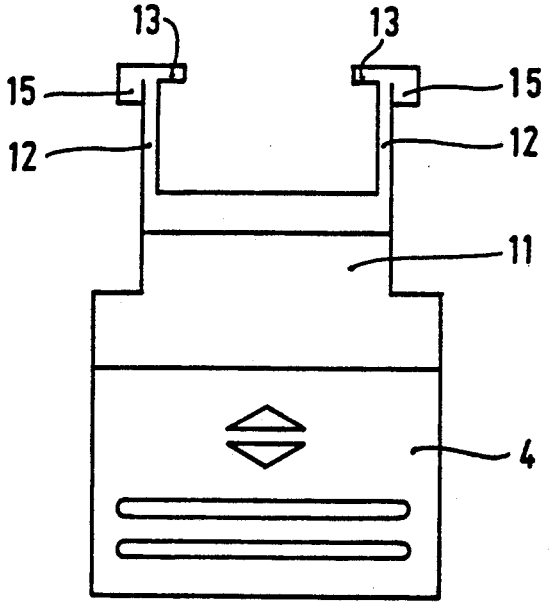

The operating member 4 (FIGS. 2, 3 and 5) is constructed as a sliding button and comprises resilient arms 8 having hook-like ends 9 which engage behind wall portion 10 of the housing 1. The operating member is coupled to the trimmer by means of the connection element 11. For this purpose the connection element 11 comprises two arms 12 having spindles 13 at the ends which are situated in the recesses 14 of the holder 6 (FIG. 4) so that the connection element 11 is connected to the trimmer so as to be rotatable. The arms 12 also comprise cams 15 at their ends. The operating member 4 and the connection element 11 are preferably manufactured as one assembly from a synthetic resin.

Figure 6:
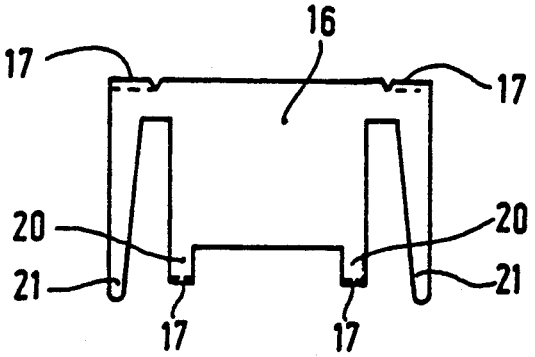
Figure 7:
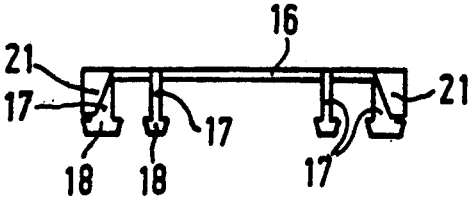
FIG. 7 is a side elevation of the resilient member of FIG. 6.

A resilient member 16 (FIGS. 6 and 7) of sheet material is connected to the holder 6 by means of bent connection lugs 17 having hook-like portions 18 which are situated in corresponding recesses 19 of the holder. Parts 20 of the resilient member 16 cover the recesses 14 so that the spindles 13 are locked in the recesses 14 by the said member 15. The resilient member 16 which is manufactured, for example, from metal, also comprises the resilient elements 21 which engage the cams 15. The trimmer 3 is journalled in the housing 1 so as to be rotatable by means of the spindles 22. The shape and dimensions of the cams are such that the resilient elements 21 are formed so as to be slightly elastical so that the cams exert forces $K_1$ on the resilient elements (FIG. 2) so that the trimmer 3 is kept in the non-operational position. By moving the operating member 4 in the direction P (FIG. 2) a torque M around the spindles 22 is exerted on the trimmer by the arms 12. As a result of this the trimmer 3 is placed in the operational position (FIG. 3) in which the wall part 23 of the trimmer holder 6 engages the abutment 24 of the housing 1. In this position the cutting unit 7 is coupled in known manner with a driving mechanism in the housing 1 via a lever 25 which is shown in broken lines in FIG. 4 as well as the cutting unit. The trimmer 3 may now be used for cutting long hairs, for example, beard or moustache.

During the rotation of the trimmer a recess 14 also traverses a part of a circular track around the spindles 22. Because the spindles 13 situated in the recesses 14 must therefore also traverse such circular tracks, the arms 12 are made to be slightly elastic.

Figure 3:
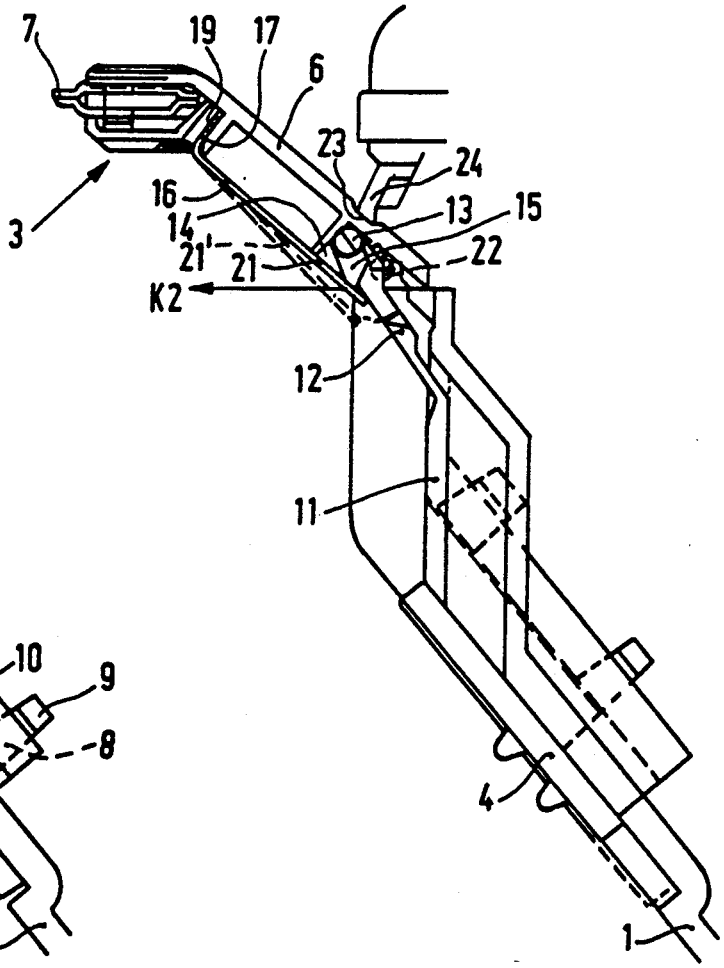
FIG. 3 is a cross-sectional view of the FIG. 2 detail with the trimmer in the operational position.

The resilient elements 21 during rotating the trimmer slide over the associated cams 15 until the position as shown in FIG. 3 has been reached in which the resilient elements also engage the cams with an elastic deformation. As a result of this the cams 15 in this position of the trimmer exert forces $K_2$ on the resilient elements 21 as a result of which the trimmer is held in the converted position. During rotating the trimmer 3 the resilient elements 21 pass a position 21' with maximum deflection as is shown in broken lines in FIG. 3. The combination of resilient element 21 and cam 15 thus acts as an "over-centre" mechanism As a result of this separate locking means for the operating member 4 become superfluous.

I claim:

1. A shaving apparatus comprising a housing having a shaving part for short hairs and a trimmer for long hairs which can be rotated with respect to the housing, the housing comprising an operating member which is coupled to the trimmer via a connection element, one end of the connection element being journalled in the trimmer so as to be rotatable, an "over-center" mechanism being present between the trimmer and the connection element and comprising a resilient element at one component, which resilient element engages a cam of the other component.

2. A shaving apparatus as claimed in claim 1, wherein the connection element comprises a spindle which is situated in a recess of the trimmer so as to be rotatable and the resilient element is connected to the trimmer and also forms a locking member for the spindle in the recess.

3. A shaving apparatus as claimed in claim 2, wherein the connection element comprises two ends which are both journalled in the trimmer so as to be rotatable and each end comprises a cam which forms an "over-center" mechanism with a resilient element connected to the trimmer and both resilient elements are parts of a resilient element of sheet material.

4. A shaving apparatus as claimed in claim 3, wherein the resilient member comprises bent connection lugs having hooklike portions, which connection lugs are situated in corresponding recesses of the trimmer.

5. A shaving apparatus comprising a housing having a shaving part for short hairs and a trimmer for long hairs which can be rotated between two positions with respect to the housing, the housing comprising an operating member which is coupled to the trimmer via a connection element, one end of the connection element being journalled in the trimmer so as to be rotatable, the combination of trimmer and connection element comprising a resilient element connected to one of these components and a cam connected to the other component, the trimmer being fixed in either of the two positions by a force between the resilient element and the cam, whereby from moving the trimmer from one position to the other position an increase and subsequently a decrease of the force between the resilient element and the cam occurs, the resilient element and the cam thus forming an "over-center" mechanism.

* * * * *